United States Patent [19]

Blanton

[11] 4,196,782

[45] Apr. 8, 1980

[54] TEMPERATURE COMPENSATED SLEEVE VALVE HYDRAULIC JAR TOOL

[75] Inventor: James R. Blanton, Dallas, Tex.

[73] Assignee: Dresser Industries, Inc., Dallas, Tex.

[21] Appl. No.: 949,482

[22] Filed: Oct. 10, 1978

[51] Int. Cl.[2] ..... E21B 1/10

[52] U.S. Cl. ..... 175/297; 166/91; 166/178

[58] Field of Search ..... 175/296, 297; 166/178, 166/91; 251/117

[56] References Cited

U.S. PATENT DOCUMENTS

| | | | |
|---|---|---|---|
| 3,323,550 | 6/1967 | Lee | 137/809 X |
| 3,340,899 | 12/1967 | Welty et al. | 138/43 |
| 3,716,109 | 2/1973 | Griffith | 175/297 |
| 3,949,821 | 4/1976 | Raugust | 175/297 |
| 4,111,271 | 9/1978 | Perkins | 175/297 |

*Primary Examiner*—Ernest R. Purser
*Assistant Examiner*—Nick A. Nichols, Jr.
*Attorney, Agent, or Firm*—Eddie E. Scott

[57] ABSTRACT

A hydraulic jarring tool includes a temperature compensated hydraulic detent actuation means. The jarring tool includes an outer member and an inner member telescopically arranged. Spline means between said outer member and said inner member transmit torque. A hammer and anvil system provide a jarring effect upon actuation of the tool. An upper seal and lower seal provide a fluid seal between said outer member and said inner member. A working fluid is maintained in a working fluid chamber between the upper and lower seals. The hydraulic detent actuation means provides a tripping action to produce the jarring effect. The hydraulic detent actuation includes a sliding sleeve member with an orifice passage that produces a detent action by the slow metering of the hydraulic working fluid. A valve means is positioned in the orifice passage for providing a consistent flow through the sleeve valve to produce the hydraulic detent irrespective of the temperature of the working fluid.

4 Claims, 3 Drawing Figures

TEMPERATURE COMPENSATED SLEEVE VALVE HYDRAULIC JAR TOOL

TECHNICAL FIELD

The present invention relates in general to the art of earth boring and, more particularly, to a rotary hydraulic jarring tool.

BACKGROUND OF THE INVENTION

During the drilling of an oil or gas well or the like, situations are encountered wherein a component of the drill string becomes lodged in the borehole. It is, of course, necessary to dislodge this component of the drill string in order to continue the drilling operation. A rotary jarring tool is positioned in the drill string to allow the striking of blows to the drill string and the loosening of and dislodging of the stuck portion of the drill string. For example, rotary jarring tools are installed in fishing strings to enable the driller to strike heavy upward blows against an engaged fish to jar it loose from its stuck position. Rotary jarring tools are included in drill strings during testing, coring and washover operations to act as safeguards and to provide a system with which to loosen the drill string should it become stuck.

Rotary jarring tools include various types of restraining or detent mechanisms which hold the telescopic elements of the jarring tool in a closed position until sufficient upward pull is exerted to trip the restraining mechanism and allow the telescopic elements to rapidly move to their extended position. The force of the upward pull stretches the drill pipe. When the restraining mechanism trips, the upward surge of the drill pipe in returning to its normal length will allow a severe blow to be imparted to the drill string by the jarring tool.

Hydraulic jarring tools utilize a hydraulic working fluid and valve system to provide the tripping action. The jarring tool includes a seal system having upper and lower seal assemblies with the working fluid located therebetween. During the drilling operation, elevated temperatures are encountered which causes the physical properties of the working fluid to change. A need exists for a valving system that is reliable and provides closely repeating tripping action over a wide range of temperatures. The jar tool should be easy to manufacture and recocking of the jar tool should be simple and quick.

DESCRIPTION OF PRIOR ART

In U.S. Pat. No. 3,716,109 to W. E. Griffith, patented Feb. 13, 1973, a rotary jar is disclosed for use in well bores when a tool, attached to the jar, becomes so stuck that normal tension on the drill string will not release it. The rotary jar has an outer housing and an inner mandrel with appropriate seals therebetween defining an annular working chamber. A knocker is attached to the mandrel and an anvil is attached to the housing. The working fluid in the working chamber exhibits low viscosity changes with high temperature changes. Within the chamber are located a piston and a valve combination so arranged that when the drill string is under high tension, fluid is forced in minute quantities through the valve combination. This is actually a mutual extension of the mandrel and housing which continues until the piston and valve combination come into contact with an annular sleeve in the chamber. The sleeve moves with the piston and valve combination allowing fluid to dump therebehind, thereby allowing the knocker and anvil to come into jarring contact. Provision is made for resetting the jar so that is may be operated continuously over long periods of time.

In U.S. Pat. No. 3,949,821 to T. A. Raugust, patented Apr. 13, 1976, a jarring and bumping tool for a drill string is described. The tool includes an inner mandrel and an outer housing telescopically coupled together and defining therebetween an annular chamber for hydraulic fluid. A floating piston assembly is located in said chamber and is moved along in the chamber by a piston displacing device carried by the mandrel. A vertical strain applied to the mandrel when the tool is in use causes the said device to lift the piston assembly. The pressure of hydraulic fluid in the said chamber cushions movement of the mandrel until the piston assembly enters an enlarged portion of the hydraulic cylinder, whereupon the hydraulic pressure is released, allowing abutment faces on the mandrel and housing to slam together and apply an upward jar to the drill string. When the mandrel is returned downwardly, the piston displacing device draws the piston assembly down in the cylinder until movement of the assembly is arrested. Continued movement of the mandrel causes the device to disengage from the piston assembly, allowing other abutment faces on the mandrel and housing to slam together and apply a downward bump to the tool. Since the piston is disengaged and stationary during a bump, piston and cylinder wear is reduced, and fluid cushioning during a bump is also reduced.

SUMMARY OF THE INVENTION

The present invention provides a hydraulic jarring tool having a temperature compensated hydraulic detent means. The jarring tool includes an outer member and an inner member telescopically arranged. Spline means between said outer member and said inner member transmit torque. A hammer and anvil system provide a jarring effect upon actuation of the tool. An upper seal and lower seal provide a fluid seal between said outer member and said inner member. A working fluid is maintained in a working fluid chamber between the upper and lower seals. The detent means provides a tripping action to produce the jarring effect. A temperature compensating valve means corrects for viscosity changes in the hydraulic fluid to provide a consistent flow rate over a wide temperature range. The valve means allows large particles to pass through the flow passages yet provides a consistent flow rate irrespective of the temperature of the hydraulic working fluid. The above and other objects and advantages of the present invention will become apparent from a consideration of the following detailed description of the invention when taken in conjunction with the accompanying drawings.

DETAILED DESCRIPTION OF THE INVENTION

Figure 1:
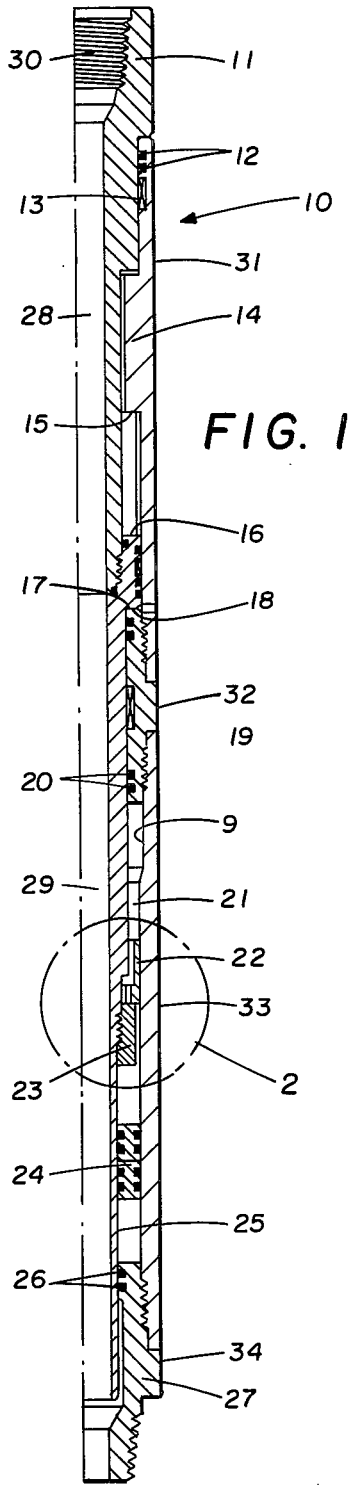
FIG. 1 is a longitudinal view illustrating an embodiment of a jarring tool constructed in accordance with the present invention.

Referring now to the drawings, and in particular to FIG. 1, a hydraulic jarring tool is illustrated therein and generally designated by the reference number 10. Only the right-half of the jarring tool 10 is shown, however, it is to be understood that the jarring tool 10 is substantially symmetrical. The jarring tool 10 is an impact tool adapted to be positioned between the lower section of the drill string (not shown) and the upper section of the drill string (not shown) connected with the drilling equipment at the surface. The jarring tool 10 is the type of tool generally called a hydraulic jar.

The hydraulic jar 10 comprises telescopically arranged inner (upper) mandrel 11 and outer (lower) mandrel 27. The inner mandrel 11 actually comprises two cylindrical hollow sections namely the box and spline mandrel section 28 and the piston and wash pipe mandrel section 29. The box connection 30 is provided with an internal thread to be connected to an external thread on the pin end of the drill string component above. The outer mandrel 27 actually comprises four sections, namely the spline mandrel section 31, seal mandrel section 32, piston mandrel section 33 and pin mandrel section 34.

The spline system of the jar 10 comprises spline 14 having radially inwardly directed splines on the inside diameter of the outer spline mandrel section 31 engageable with radially outwardly direct splines on the outside diameter of the inner box and spline mandrel section 28. The spline 14 provides a system for transmitting torque and providing telescoping movement of the inner mandrel 11 and outer mandrel 27. A jarring effect is provided by contact between the hammer 16 and anvil 15 when the jar 10 extends and by contact between the hammer 17 and anvil 18 when the jar 10 retracts. The bearings 13 and 19 improve axial movement of mandrels 11 and 27. The wipers 12 and 26 restrict the entry of foreign materials into the working parts of the jar 10.

An annular hydraulic working fluid chamber 21 is provided between inner (upper) mandrel 11 and outer (lower) mandrel 27. The seals 20 provide a fluid seal closing the upper portion of hydraulic chamber 21. The lower portion of the working fluid chamber 21 is sealed by a piston type seal assembly 24. The lower seal assembly 24 comprises a floating compensating annular seal between the outer mandrel 27 and the wash pipe section 25 of the inner mandrel 11. The seal assembly 24 can slide axially along the working chamber area 21 to compensate for volume changes.

An annular sliding sleeve valve detent actuation means 22 is disposed in the hydraulic working chamber 21. The sleeve valve means 22 is mounted for limited longitudinal movement in chamber 21 and forms a seal by means of 0.0015" interference fit between the cylindrical surfaces of the inner and outer mandrels 11 and 27. An annular lower stop member 23 is located below the sleeve valve means 22 in the working chamber 21. The sleeve valve means 22 acts as a detent or restraining mechanism providing for the slow metering of the hydraulic working fluid from the upper chamber portion above the sleeve valve means 22 to the lower chamber portion below when the inner mandrel 11 is pulled upwardly relative to the outer mandrel 27 by tensioning the drill string. The sleeve valve system will be described in greater detail subsequently. A release section 9 of working fluid chamber 21 is located above sleeve valve means 22. When the sleeve valve means 22 comes adjacent release section 9 of the chamber 21, the wall contact is removed. The working fluid still remaining in compression in chamber 21 will be dumped around the O.D. of the sleeve valve means 22 and behind the sleeve valve means 22 thereby drastically reducing the resistance of working fluid and permitting upward strain on inner mandrel 11 to bring the hammer 16 and anvil 15 into jarring impact.

Figure 2:
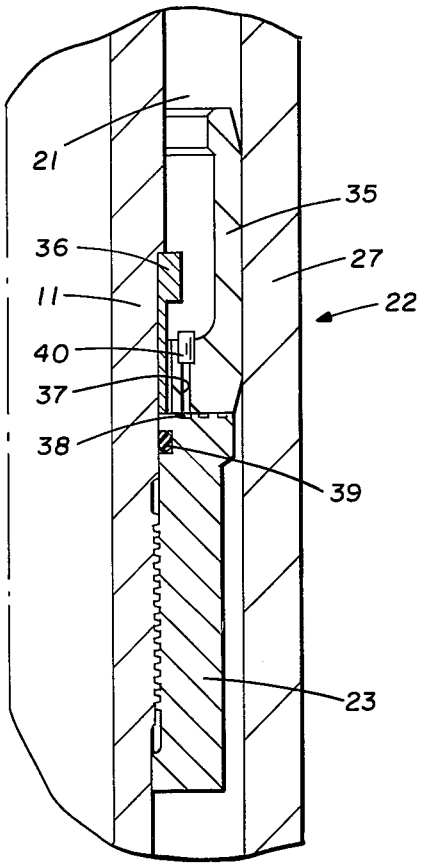
FIG. 2 is an enlarged view of a portion of the jarring tool shown in FIG. 1.

Referring now to FIG. 2, an enlarged view of the sleeve valve means 22 is shown. The sleeve means 22 includes an annular sleeve valve body 35 positioned between the inner mandrel 11 and the outer mandrel 27. The sleeve valve body 35 forms a seal by means of 0.0015" interference fit between the cylindrical surfaces of the inner mandrel 11 and the outer mandrel 27. A passageway 37 extends longitudinally through the sleeve valve body 35. The annular lower stop member 23 is located downhole of the sleeve valve means 22 in the working chamber 21. A radial groove 38 is provided in stop member 23. Changes in temperature of the working fluid create changes in the physical characteristics of the working fluid. In order to compensate for such changes, a valve member 40 is positioned in a passageway 37 and compensates for temperature changes. The fluid is slowly metered through valve member 40, passageway 37 and groove 38.

Figure 3:
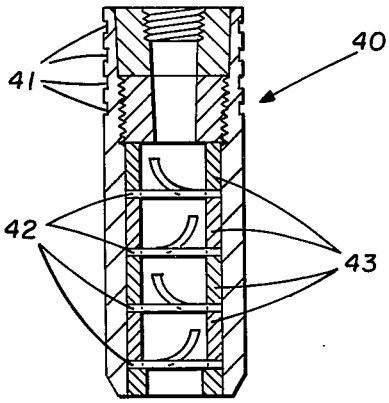
FIG. 3 is an enlarged view illustrating the valve means shown in FIG. 2.

Referring now to FIG. 3, an illustration of the valve member 40 is shown. A series of grooves in the O.D. of the valve member 40 retain it in the passageway 37. A series of restrictor orifice plates 42 in the valve member 40 create turbulent flow as the fluid travels through valve member 40. The valve member 40 allows large particles to pass through the flow passages while spinning the fluid first in one direction and later in the opposite to create pressure drops. The spin rates are inversely proportional to fluid viscosity. The valve member 40 corrects for viscosity changes in the hydraulic fluid to provide a constant flow rate over a wide temperature range. This type of valve is commercially available, for example, a valve of this type may be purchased from The Lee Company, 2225 East Randol Mill Road, Arlington, Texas. Temperature compensated flow control valves are also shown in U.S. Pat. No. 3,340,899 to F. Weltz et al, patented Sept. 12, 1967 and U.S. Pat. No. 3,323,550, to L. Lee II, patented June 6, 1967.

The structural details of one embodiment of a jarring tool 10 constructed in accordance with the present invention having been described, the operation of the jarring tool 10 will now be considered with reference to FIGS. 1–3 of the drawings. A lower drill string section or borehole tool is attached to the end of lower mandrel 27 at the threaded pin. The box connection on upper mandrel 11 is attached to a drill string. The working fluid fills the working chamber 21. The jarring tool 10 and drill string are lowered into the borehole and the borehole operations continue. If a section of the lower drill string or borehole tool becomes tightly wedged in the borehole, a jarring action may be applied through the jarring tool 10 to attempt to dislodge the stuck portion.

The jarring tool 10 is initially in a fully contracted condition. An axial force is applied to the inner mandrel 11 through the drill string. This puts the working fluid into compression. The only way to relieve the internal pressure in the working fluid is through the sleeve valve means 22. A small portion of working fluid will pass through the sleeve valve means 22 into that portion of working chamber 21, which is between sleeve valve means 22 and the seal and valve assembly 24. The sleeve valve means 22 will rise, relatively, in working chamber 21 at an extremely slow speed. The annular grooves 38 in the lower stop member 23 cooperate with the valve member 40 and the passage 37 in the sliding sleeve valve body 35 to provide orifice passages that produce a detent action by the slow metering of the hydraulic working fluid. When the sleeve valve means 22 comes adjacent release section 9 of the chamber 21, the wall contact is removed. The working fluid still remaining in compression in chamber 21 will be dumped around the sleeve valve means 22 and behind the sleeve valve means 22 thereby drastically reducing the resistance of working fluid and permitting the upward strain to bring the hammer 16 and anvil 15 into a jarring impact. The jarring effect is transmitted through outer mandrel 27 to the stuck portion which might then be dislodged.

The valve member 40 corrects for viscosity changes in the hydraulic working fluid to provide a constant flow rate over a wide temperature range. The restrictor orifice plates 42 in the valve member 40 create turbulent flow as the fluid travels through valve member 40. The valve member 40 allows large particles to pass through the flow passages while spinning the fluid first in one direction and later in the opposite to create pressure drops. The spin rates are inversely proportional to fluid viscosity thereby providing a consistent flow rate irrespective of the temperature of the hydraulic working fluid.

To reset the jarring tool 10, it is only necessary to allow the weight of the drill string above to be set down on the jarring tool 10. Working fluid travels into the portion of working chamber 21 located above sleeve valve 22. The sleeve body 35 moves upward to the stop 36. This allows the passage 37 to act as large bypass holes through the sleeve element allowing working fluid to flow rapidly in the opposite direction to recock the jar tool. Once the contraction is fully complete, the jarring tool 10 is ready to deliver another blow when required.

The embodiments of the invention in which an exclusive property or privelege is claimed are defined as follows:

1. A hydraulic jarring tool, comprising:
an outer member;
an inner member, said outer member and said inner member being telescopically arranged;
spline means between said outer member and said inner member for transmitting torque;
an operating fluid between said inner member and said outer member, said operating fluid occasionally containing particles;
seal means located between said inner member and said outer member for sealing said operating fluid thereby providing an operating fluid chamber; and
sleeve valve means in said operating fluid chamber for metering said operating fluid, said sleeve valve means including a valve member that provides temperature compensation to said operating fluid providing a consistent flow rate of operating fluid while allowing said particles to pass through said valve member, said valve member having a flow passage with restrictor orifice plates in said flow passage that cause operating fluid passing therethrough to spin at spin rates inversely proportional to the viscosity of said operating fluid.

2. A hydraulic jarring tool which comprises a tubular housing having one end attachable to a drill string component, a mandrel extending into said housing and having an end portion externally of said housing attachable to a drill string component, said mandrel having a splined connection with said housing permitting nonrotative reciprocating movement of said mandrel relative to said housing, said housing having an internal annular shoulder constituting an anvil, said mandrel having an annular shoulder confronting said internal annular shoulder and constituting a hammer, means forming a substantially confined annular working fluid chamber between said mandrel and housing for reception of a working fluid, a working fluid in said working fluid chamber, said working fluid occasionally containing particles, a sleeve member in said chamber slidingly mounted on said mandrel, said sleeve member having a fluid passage extending therethrough and temperature compensation valve means in said fluid passage to provide temperature compensation to said working fluid providing a consistent flow rate of working fluid irrespective of temperature said valve means including a valve member that provides temperature compensation to said working fluid providing a consistent flow rate of working fluid while allowing said particles to pass through said valve member, said valve member having a flow passage with restrictor orifice plates in said flow passage that cause working fluid passing therethrough to spin at spin rates inversely proportional to the viscosity of said working fluid.

3. A hydraulic jarring tool, comprising:
an outer member;
an inner member, said outer member and said inner member being telescopically arranged;
spline means between said outer member and said inner member for transmitting torque;
an anvil and hammer means for providing a jarring effect;
an operating fluid between said inner member and said outer member, said operating fluid occasionally containing particles;
a first seal element between said outer member and said inner member for providing a fluid seal to contain said operating fluid;
a second seal element between said outer member and said inner member for providing a fluid seal to contain said operating fluid; and
detent means for actuating said anvil and hammer means, said detent means including a sleeve valve member mounted for axial travel between said outer member and said inner member, passage means extending through said sleeve valve member and a temperature compensating valve means in said passage means for providing a consistent flow of hydraulic fluid irrespective of temperature, said valve means including a valve member that provides temperature compensation to said operating fluid providing a consistent flow rate of operating fluid while allowing said particles to pass through said valve member, said valve member having a flow passage with restrictor orifice plates in said flow passage that cause operating fluid passing therethrough to spin at spin rates inversely proportional to the viscosity of said operating fluid.

4. A hydraulic jarring tool, comprising:
an outer member;

an inner member, said outer member and inner member telescopically arranged;

spline means between said outer member and said inner member for transmitting torque;

an anvil and hammer means for providing a jarring effect;

first seal means between said outer member and said inner member for providing a fluid seal;

second seal means between said outer member and said inner member for providing a fluid seal;

a working fluid chamber between said inner member and said outer member;

a working fluid contained in said working fluid chamber, said working fluid occasionally containing particles;

a sleeve valve body moveable in said working fluid chamber, said sleeve valve body having a surface;

a stop member having a surface in said working fluid chamber;

at least one groove between said surface of said sleeve valve body and said surface of said stop member;

at least one passage extending through said sleeve valve body into said groove; and a temperature compensating valve means in said passage for providing a consistent flow of hydraulic fluid irrespective of temperature, said valve means including a valve member that provides temperature compensation to said working fluid providing a consistent flow rate of working fluid while allowing said particles to pass through said valve member, said valve member having a flow passage with restrictor orifice plates in said flow passage that cause working fluid passing therethrough to spin at spin rates inversely proportional to the viscosity of said working fluid.

* * * * *